US007106257B2

(12) United States Patent
Liu et al.

(10) Patent No.: US 7,106,257 B2
(45) Date of Patent: Sep. 12, 2006

(54) DUAL-BAND INVERTED-F ANTENNA

(75) Inventors: I-Ru Liu, Taipei (TW); Hong-Kun Tyan, Taoyuan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 10/998,633

(22) Filed: Nov. 30, 2004

(65) Prior Publication Data

US 2005/0264456 A1 Dec. 1, 2005

(30) Foreign Application Priority Data

Jun. 1, 2004 (TW) ..... 93115712 A

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/702, 343/700 MS
See application file for complete search history.

(56) References Cited

U.S. PATENT DOCUMENTS 5,627,551 A * 5/1997 Tsuru et al. ..... 343/700 MS
6,538,605 B1 * 3/2003 Lebaric et al. ..... 343/700 MS
6,680,705 B1 * 1/2004 Tan et al. ..... 343/702
6,911,945 B1 * 6/2005 Korva ..... 343/702
6,930,642 B1 * 8/2005 Kossiavas et al. ..... 343/702
2003/0107518 A1 * 6/2003 Li et al. ..... 343/702
2004/0207559 A1 * 10/2004 Milosavljevic ..... 343/702
2004/0263420 A1 * 12/2004 Werner et al. ..... 343/909

FOREIGN PATENT DOCUMENTS

WO 2005/038981 A1 * 4/2005

* cited by examiner

*Primary Examiner*—Trinh Vo Dinh
(74) *Attorney, Agent, or Firm*—Bacon & Thomas, PLLC

(57) ABSTRACT

A dual-band inverted-F antenna includes a ground substrate, a radiating body, a first ground part, a second ground part and a feed point. The ground substrate has a ground surface. The radiating body at least has a first side, a second side, a third side, and a split. The first side and the second side form a first included angle, while the second side and the third side form a second included angle. The third side is disposed opposite to the first side, and the split is positioned from the first side to the second side. The first ground part is extended along the third side with a first distance away from the second side. The second ground part is extended along the second side with a second distance away from the first side. A third distance is set between the feed point and the second side.

12 Claims, 5 Drawing Sheets

DUAL-BAND INVERTED-F ANTENNA

CROSS REFERENCE TO RELATED APPLICATIONS

This Non-provisional application claims priority under 35 U.S.C. §119(a) on Patent Application No. 093115712 filed in Taiwan, Republic of China on Jun. 1, 2004, the entire contents of which are hereby incorporated by reference.

BACKGROUND OF THE INVENTION

1. Field of Invention

The invention relates to a dual-band inverted-F antenna and, in particular, to the dual-band inverted-F antenna, which has reduced dimensions and increased operation bandwidth.

2. Related Art

Antenna is a key element for transmitting and receiving the magnetic wave in the wireless communication system. Without the antenna, the wireless system could not transmit and receive information. As a result, the antenna plays an important role in the wireless communication. Choosing a proper antenna not only is helpful to match up with the outward appearance of products, but also can improve the signal quality of the transmission or reception. Moreover, a proper antenna also can reduce the production cost. According to different product application, the antenna can be designed in various ways and made of various materials. Besides, the usable band is different in every country. Therefore, there are lots of points should be considerated. At present time, IEEE 802.11, DECT, and 802.15.1 (Bluetooth) are common standards of the usable bands. Among them, the usable band for DECT is 1.88 GHz, and that for Bluetooth is 2.4 GHz. The 802.11 includes 802.11a and 802.11b/g standards, which has the band of 5 GHz and 2.4 GHz respectively.

In the prior art, the antenna body is made of a coaxial cable or a printed circuit board. Because of the material and the structure of the conventional antenna, it is high cost to produce the antenna. In addition, the dimension of the conventional antenna is not easily minimized, and the performance thereof is hardly controlled.

Recently, dual-band inverted-F antennas have been developed. It's very common to be applied in the wireless communication system, since its small dimension, simple structure, and good gains.

According to FIG. 1, the conventional dual-band inverted-F antenna 1 for receiving or transmitting signals has a radiation patch 11, a shorting pin 12, a feed point 13, and a ground plate 14. In this case, the shorting pin 12 is disposed on one side of the radiation patch 11 and the radiation patch 11 electrically connects to the ground plate 14. The feed point 13 connects a feed node of the radiation patch 11 to the ground plate 14. Thus, the inverted-F antenna 1 is obtained.

For the inverted-F antenna to receive or transmit the signals in some bands, a current should be fed in from the feed point so as to induce resonance in the radiation patch 11. Utilizing the generated band according to resonance, the antenna can receive or transmit signals of specific band. Additionally, if another radiation patch (not shown) is disposed on the radiation patch 11 through a connecting portion, the inverted-F antenna could be applied to two different bands.

As described above, the band of the conventional inverted-F antenna only covers some ranges. Consequently, different countries have different limitations in the usable bands. The inverted-F antenna products cannot be applied into different country areas. In additional, it's hard to minimize the dimension of the antenna applied for the smaller electronic products.

Therefore, it is an important subjective to minimize the dimension of the inverted-F antenna, increase the effective bandwidth of the inverted-F antenna, and manufacture the inverted-F antenna products, which can meet needs of more countries.

SUMMARY OF THE INVENTION

In view of the foregoing, this invention is to provide a dual-band inverted-F antenna, which is minimized in dimension, is capable of increasing the effective bandwidth thereof, and is capable of being applied for two different bands.

To achieve the above, a dual-band inverted-F antenna includes a ground substrate, a radiating body, a first ground part, a second ground part and a feed point. The ground substrate has a ground surface. The radiating body is a flat plate and at least has a first side, a second side, a third side, and a split. The first side and the second side form a first included angle, while the second side and the third side form a second included angle. The third side is disposed opposite to the first side, and the split is positioned from the first side to the second side. The first ground part is extended along the third side with a first distance away from the second side. The second ground part is extended along the second side with a second distance away from the first side. A third distance is provided between the feed point and the second side.

The invention further provides a radiating assembly for dual-band inverted-F antenna. The radiating assembly includes a radiating body, a first ground part, and a second ground part. The radiating body is a flat plate and at least has a first side, a second side, a third side, and a split. In this case, the first side and the second side form a first included angle, and the second side and the third side form a second included angle. The third side is disposed opposite to the first side, and the split is positioned from the first side to the second side. The first ground part is extended along the third side with a first distance away from the second side. The second ground part is sheet-shaped, and is extended along the second side with a second distance away from the first side.

As mentioned above, the dual-band inverted-F antenna according to the invention uses the split to achieve the effect of dual-band. Moreover, the ground part is disposed at a specified position, which generates an additional path for the current flow. Thus, the total current pathways become more complex. As a result, the dimension of the antenna can be minimized and the bandwidth of the antenna can be increased.

BRIEF DESCRIPTION OF THE DRAWINGS

The invention will become more fully understood from the detailed description given herein below illustrations only, and thus is not limitative of the present invention, and wherein.

DETAILED DESCRIPTION OF THE INVENTION

The dual-band inverted-F antenna and the radiating assembly thereof according to preferred embodiments of the invention will be described herein below with reference to the accompanying drawings, wherein the same reference numbers refer to the same elements.

First of all, according to FIG. 2 to FIG. 4D, a radiating assembly of the preferred embodiment of the invention is described below.

Figure 1:
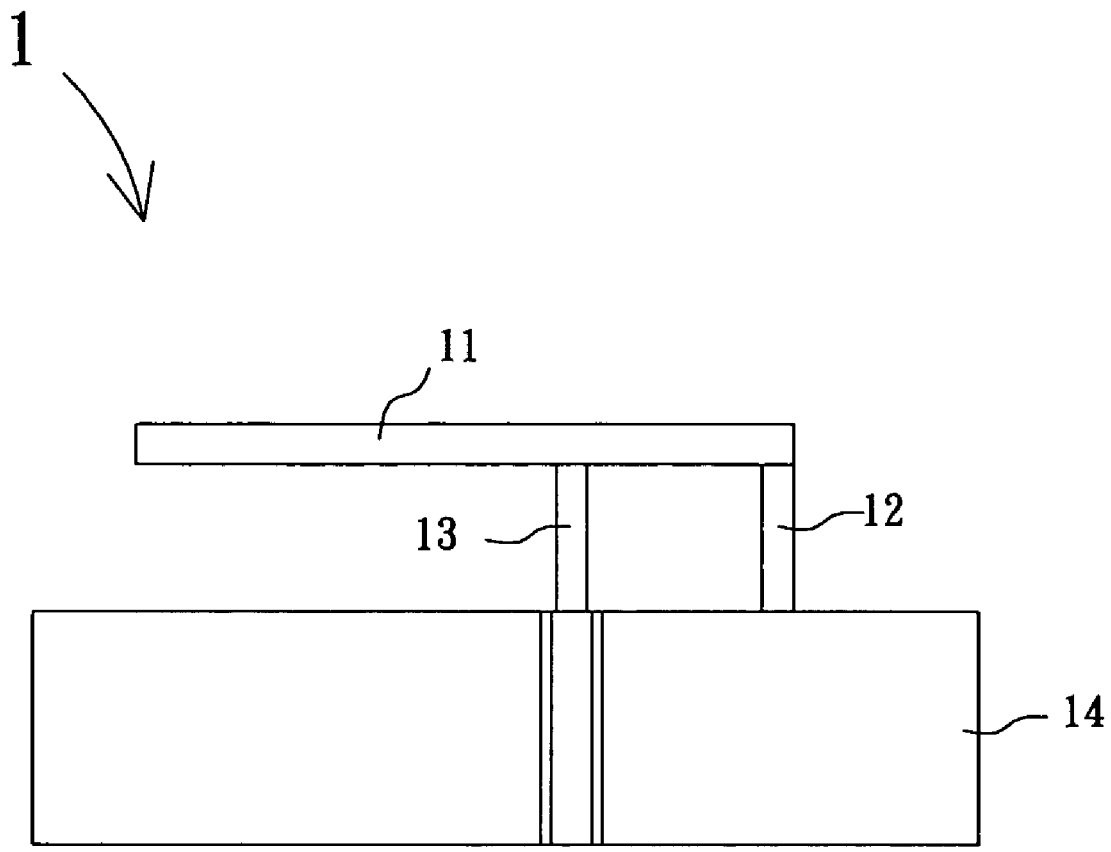
FIG. 1 PRIOR ART
FIG. 1 is a schematic view of the conventional inverted-F antenna.
Figure 2:
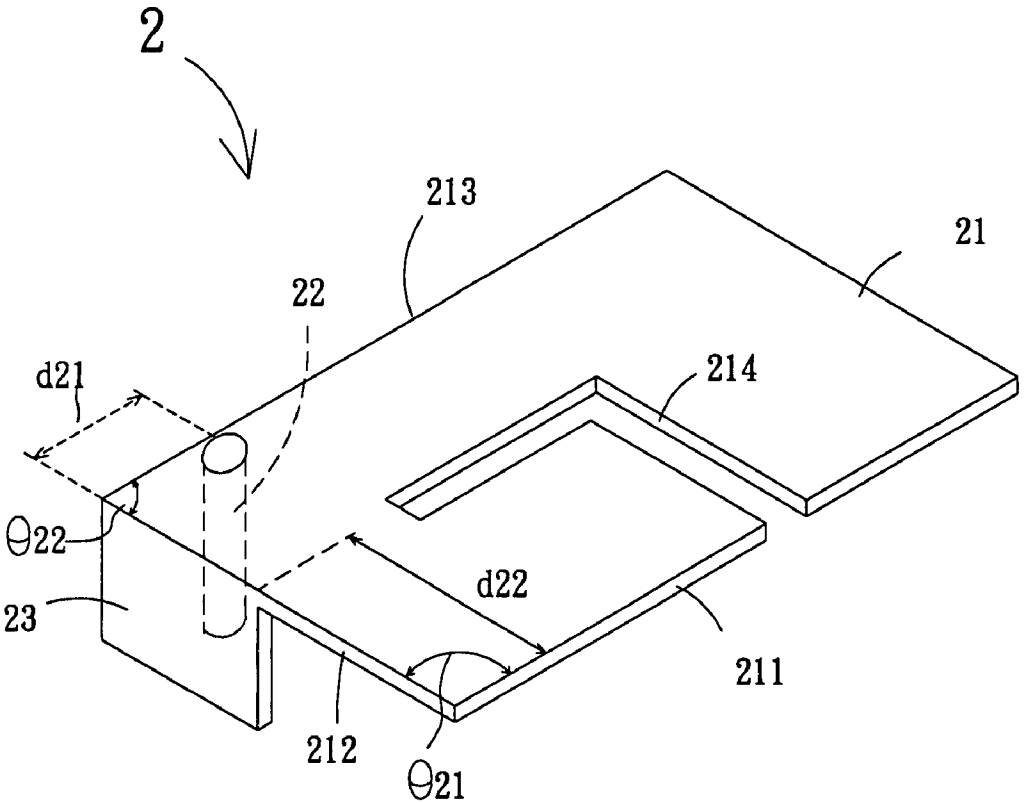
FIG. 2 is a schematic view of a radiating assembly for the dual-band inverted-F antenna according to a preferred embodiment of the invention.

Referring to FIG. 2, the radiating assembly for the dual-band inverted-F according to a preferred embodiment of the invention includes a radiating body 21, a first ground part 22, and a second ground part 23. In the current embodiment, the radiating body 21 is a flat plate and at least has a first side 211, a second side 212, and a third side 213. The first side 211 and the second side 212 form a first included angle θ21. The second side 212 and the third side 213 form a second included angle θ22. Wherein, the sum of the first included angle θ21 and the second included angle θ22 are 180 degrees. In the embodiment, the first included angle θ21 and the second included angle θ22 are all right angles. Besides, the third side 213 is disposed opposite to the first side 211. A split 214 is positioned from the first side 211 to the second side 212. In the embodiment, the split 214 is L-shaped.

The first ground part 22 is extended along the third side 213 with a first distance d21 away from the second side 212. The second ground part 23 is sheet-shaped and extended along the second side 212 with a second distance d22 away from the first side 211. In this case, the second distance d22 is greater than or equal to a half of the length of the second side 212. The first distance d21 is between ⅖ to ⅗ time of the difference of the second distance d22 and the length of the second side 212. It is preferred for the distance within a half of the difference between the second distance d22 and the length of the second side 212.

Figure 3:
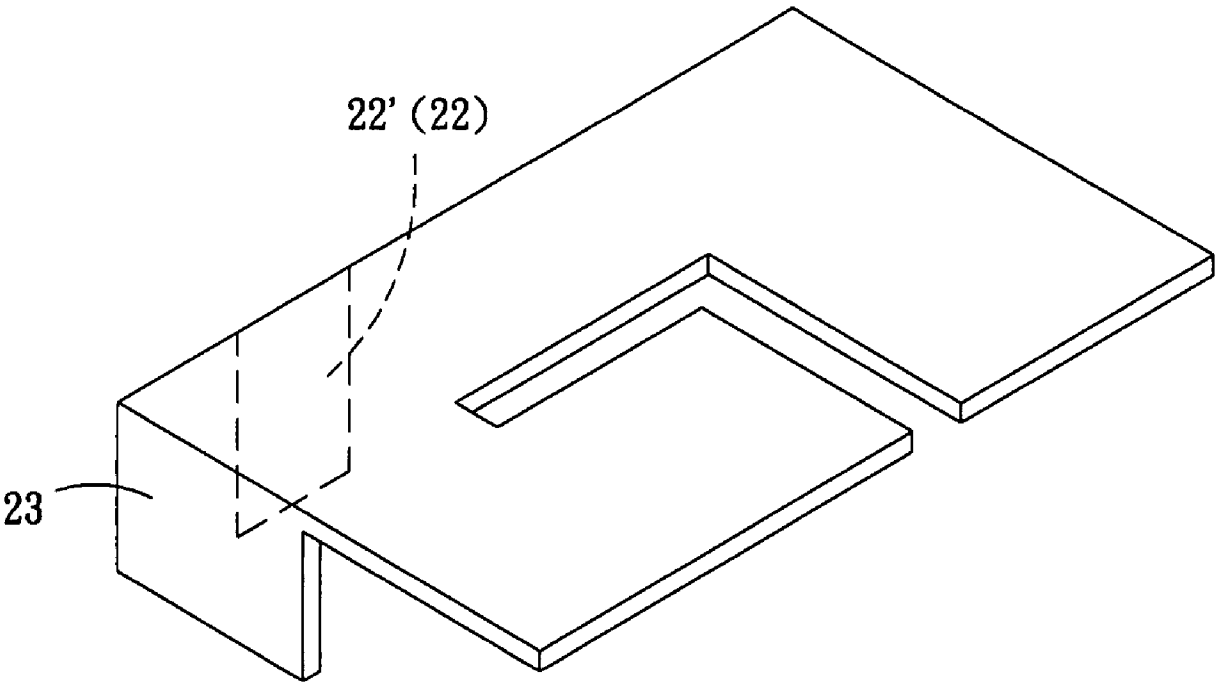
FIG. 3 is another schematic view of a radiating assembly for the dual-band inverted-F antenna according to a preferred embodiment of the invention.
Figure 4A:
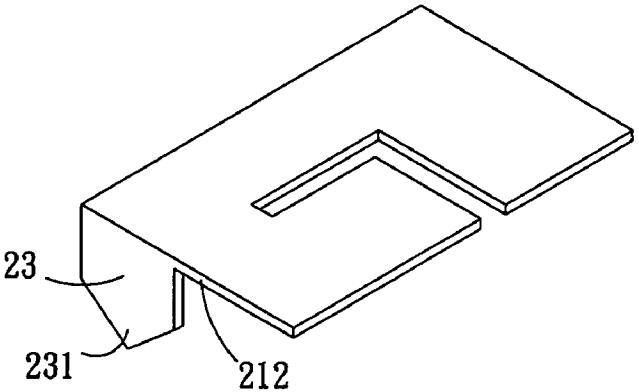
FIGS. 4A to 4D are schematic views of a convex portion and a concave portion of a second ground part in a radiating assembly for dual-band inverted-F antenna according to a preferred embodiment of the invention.
Figure 4B:
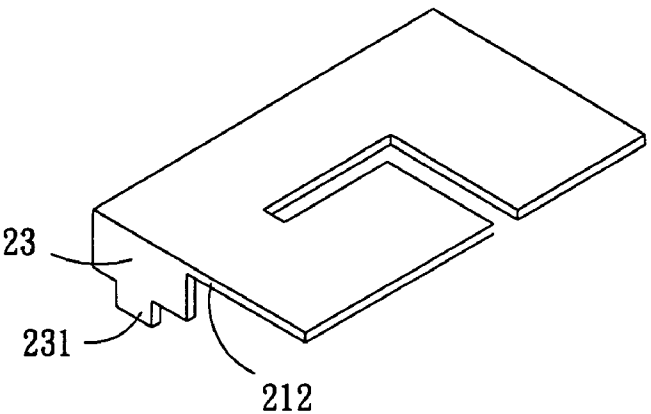
Figure 4C:
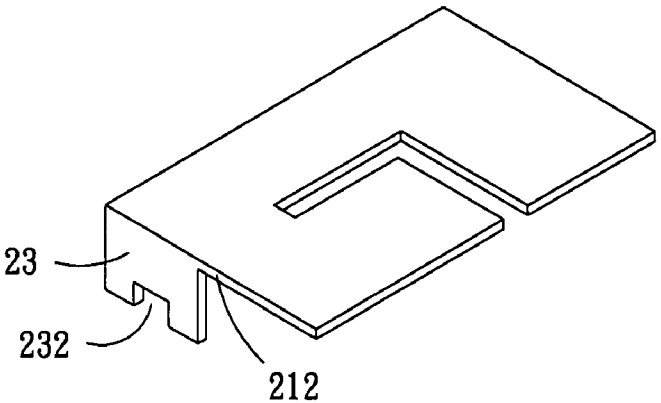
Figure 4D:
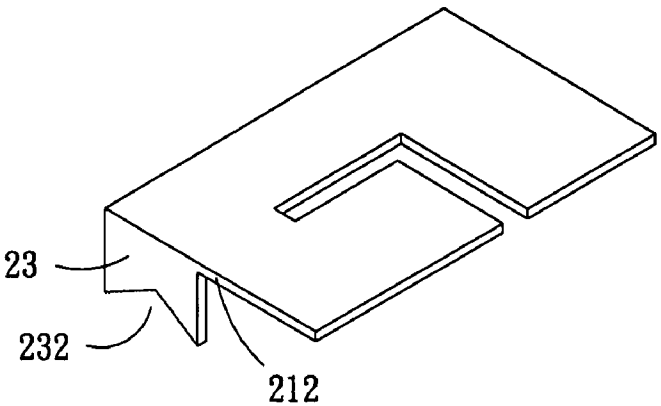

The first ground part 22 could be a wire; otherwise, also it could be a sheet-shaped conductor 22' as shown in FIG. 3. As shown in FIGS. 4A to 4D, one end of the second ground part 23 opposite to the second side 212 at least has a convex portion (sharp-shaped or bump-like) 231 or a concave portion 232. Furthermore, the radiating body 21, the first ground part 22 and the second ground part 23 are integrally formed to be a dual-band inverted-F antenna radiating assembly 2.

Figure 5:
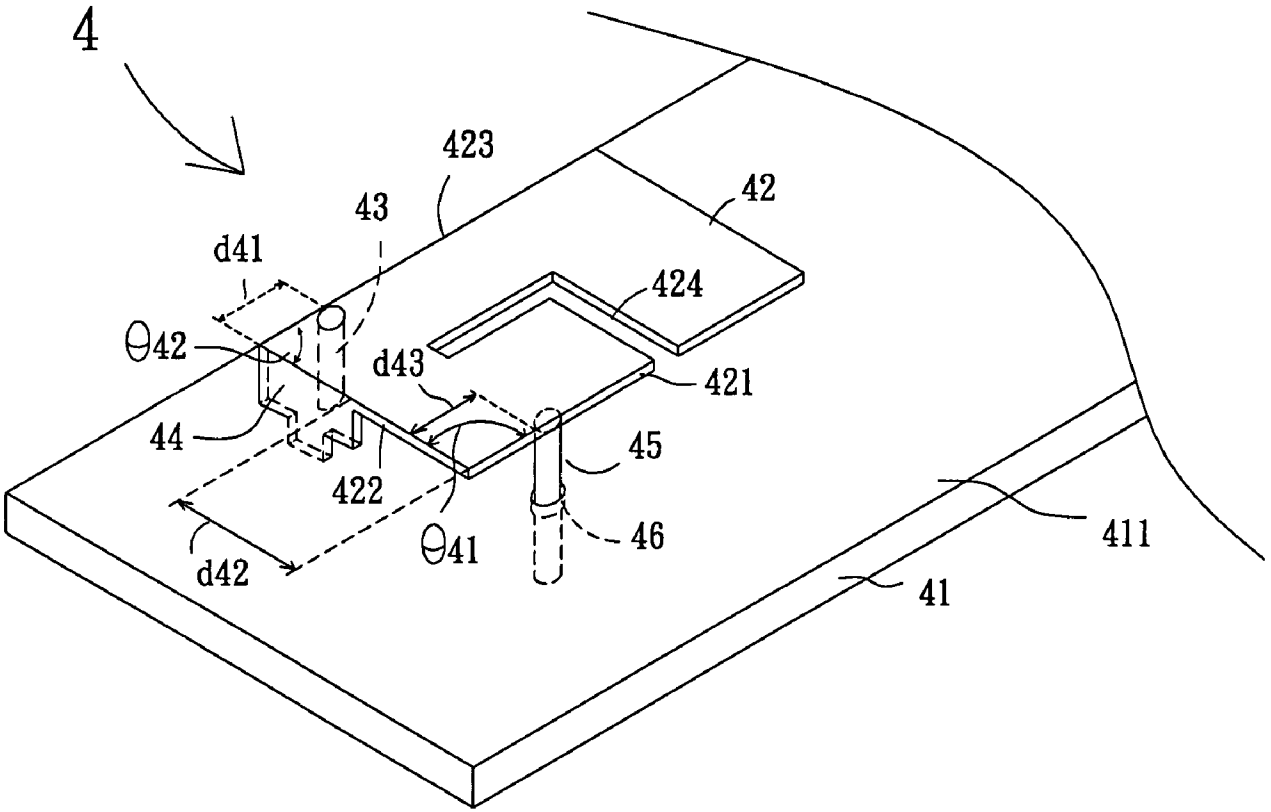
FIG. 5 is a schematic view of a dual-band inverted-F antenna according to a preferred embodiment of the invention.

Secondly, according to FIG. 5, the dual-band inverted-F antenna of the preferred embodiment of the invention is disclosed.

As shown in FIG. 5, a dual-band inverted-F antenna 4 of a preferred embodiment of the invention includes a ground substrate 41, a radiating body 42, a first ground part 43, a second ground part 44 and a feed point 45.

In the current embodiment, the ground substrate 41 has a ground surface 411. The ground surface 411 is made of conductive material and is for electrically connecting to the radiating assembly. The radiating body 42 is a flat plate and at least has a first side 421, a second side 422, and a third side 423. The first side 421 and the second side 422 form a first included angle θ41. The second side 422 and the third side 423 form a second included angle θ42. Wherein, the sum of the first included angle θ41 and the second included angle θ42 are 180 degrees. In the embodiment, first included angle θ41 and the second included angle θ42 are all right angles. Besides, the third side 423 is disposed opposite to the first side 421. A split 424 is positioned from the first side 421 to the second side 422. In the embodiment, the split 424 is L-shaped.

The first ground part 43 is extended along the third side 423 with a first distance d41 away from the second side 422. The first ground part 43 electrically connects to the ground surface 411. The second ground part 44 is sheet-shaped and extended along the second side 422 with a second distance d42 away from the first side 421. The second ground part 44 electrically connects to the ground surface 411. The feed point 45 electrically connects to the first side 421 and a third distance d43 is between the feed point 45 and the second side 422. In this case, the second distance d42 is greater than or equal to a half of the length of the second side 422. The first distance d41 is between ⅖ to ⅗ time of the difference of the second distance d42 and the length of the second side 422. Moreover, the first distance d41 is proper within a half of the difference of the length of the second side 422 and the second distance d42. In the current embodiment, the first distance d41 is 1.975 mm, and the second distance d42 is 6 mm. However, in real manufacturing processes, the error tolerance of these distances is ±10% by manual or by machine.

The first ground part 43 could be a wire; otherwise, also it could be a sheet-shaped conductor 22' (shown in FIG. 3). As shown in FIGS. 4A to 4D and FIG. 5, the end of the second ground part 44 opposite to the second side 422 at least has a convex portion (sharp-shaped or bump-like) 231 or a concave portion 232. The convex portion 231 or the concave portion 232 is embedded in the ground part 411 and forms electrically connection. As a result, the structure of the dual-band inverted antenna 4 will be stronger. Besides, a foam gel could be disposed in the space between the radiating body 42 and the ground substrate 41, so as to avoid the electrical connecting to the ground surface 411 except through the first ground part 43 and the second ground part 44. In the current embodiment, the feed point 45 passes through the hole 46 on the ground substrate 41 and electrically connects with the first side 421. The feed point 45 can be used to transmit current signals.

In the embodiment, the ground substrate 41, the radiating body 42, the first ground part 43, the second ground part 44 and feed points 45 are integrally formed to construct a dual-band inverted-F antenna 4.

As mentioned above, the dual-band inverted-F antenna 4 of the invention takes the advantage of the split 424 to achieve the effect of dual bands. On the other hand, there are two ground parts (the first ground part 43 and the second ground part 44) of the antenna, which make the pathways on the antenna 4 more complex. When the electrical signals passed by the feed points 45, the radiating body 42 possesses two different resonance points. As a result, the antenna gets a broader bandwidth of dual-band, which could be applied in IEEE 802.11a, 802.11b/g, Bluetooth, DECT, or other bands. Furthermore, owing to the two ground parts of the dual-band inverted-F antenna 4 of the invention, the dimension of the dual-band inverted-F antenna can be reduced and the effective bandwidth can be increased for applying to smaller electronic product.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A dual-band inverted-F antenna, comprising:

a ground substrate, which has a ground surface and a through hole;

a radiating body, which is a flat plate and at least has a first side, a second side, a third side, and a split, wherein the first side and the second side form a first included angle, while the second side and the third side form a second included angle, the third side is disposed opposite to the first side, and the split is positioned from the first side to the second side;

a first ground part, which is extended along the third side with a first distance away from the second side, and electrically connects to the ground surface;

a second ground part, which is sheet-shaped, is extended along the second side with a second distance away from the first side, and electrically connects to the ground surface; and a feed point passing through the through hole and electrically connected, to the first side of the radiating body, wherein a third distance is set between the feed point and the second side.

2. The dual-band inverted-F antenna of claim 1, wherein the ground surface is made of conductive material.

3. The dual-band inverted-F antenna of claim 1, wherein the radiating body, the first ground part and the second ground part are integrally formed.

4. The dual-band inverted-F antenna of claim 3, further comprising:

a foam gel, which is disposed between the radiating body and the ground substrate.

5. The dual-band inverted-F antenna of claim 1, wherein the split is L-shaped.

6. The dual-band inverted-F antenna of claim 1, wherein the sum of the first included angle and the second included angle are 180 degrees.

7. The dual-band inverted-F antenna of claim 1, wherein the first ground part is a wire.

8. The dual-band inverted-F antenna of claim 1, wherein the first ground part is a sheet-shaped conductor.

9. The dual-band inverted-F antenna of claim 1, wherein one end of the second ground part opposite to the second side further comprises a convex portion.

10. The dual-band inverted-F antenna of claim 1, wherein one end of the second ground part opposite the second side further comprises a concave portion.

11. The dual-band inverted-F antenna of claim 1, wherein the second distance is greater than or equal to a half of a length of the second side.

12. The dual-band inverted-F antenna of claim 1, wherein the first distance is between ⅖ to ⅗ time of the difference between the second distance and a length of the second side.

* * * * *